United States Patent [19]

Murch, Jr.

[11] 4,387,699

[45] Jun. 14, 1983

[54] SPACE HEATING STOVE

[76] Inventor: Charles J. Murch, Jr., Box 77, Franklin, Me. 04634

[21] Appl. No.: 261,046

[22] Filed: May 6, 1981

[51] Int. Cl.[3] ..... F24C 1/14

[52] U.S. Cl. ..... 126/61; 126/64; 126/66; 126/69; 126/75; 126/83

[58] Field of Search ..... 126/58, 60, 61, 62, 126/63, 64, 65, 66, 67, 68, 69, 75, 79, 83, 110 R, 110 E, 102, 104, 114

[56] References Cited

U.S. PATENT DOCUMENTS

| | | | |
|---|---|---|---|
| 505,772 | 9/1893 | Larson | 126/69 |
| 945,994 | 1/1910 | Vondenbosch | 126/79 X |
| 969,117 | 8/1910 | Pollard | 126/58 |
| 2,411,324 | 11/1946 | Gagnon | 126/83 |
| 3,171,399 | 3/1965 | Kirgan | 126/110 R |
| 4,140,101 | 2/1979 | Glover | 126/110 R |
| 4,171,693 | 10/1979 | Pearson | 126/60 X |
| 4,180,052 | 12/1979 | Henderson | 126/69 X |
| 4,233,955 | 11/1980 | McCallum et al. | 126/61 |
| 4,301,783 | 11/1981 | Buckner et al. | 126/63 |
| 4,320,741 | 3/1982 | Pierce | 126/63 X |

*Primary Examiner*—Samuel Scott
*Assistant Examiner*—Margaret A. Focarino
*Attorney, Agent, or Firm*—Donald A. Kettlestrings

[57] ABSTRACT

An efficient space heating stove having a combustion chamber substantially completely enclosed with insulating firebrick whereby the operating temperatures within the combustion chamber can be maintained above the ignition temperature of the fuel being consumed. Combustible gases liberated by the wood fuel are burned as they pass through a perforated, hollow, tubular member located within the combustion chamber and through which the combustible gases must pass before they are exhausted from the stove. Fuel within the combustion chamber is efficiently burned before useful heat energy is extracted.

12 Claims, 6 Drawing Figures

72
67
66
74
46
62
64
70
56
65
58
54
68
66
52
60
50'
48
92
90
50
44
36
38
38
38
38
30
32

SPACE HEATING STOVE

This invention relates to space heating apparatus which burns solid fuel, and more particularly to a wood-burning, space-heating stove having a combustion chamber capable of maintaining operating temperatures above the ignition temperature for the fuel being consumed, and having a perforated, hollow tubular member within the combustion chamber for burning the combustible gases liberated by the fuel.

Many types of space heating stoves and furnaces are known. Although such stoves and furnaces have served the purpose, they have not proved entirely satisfactory under all conditions of service because the stoves are not capable of maintaining temperatures within the combustion chamber above the ignition temperature of the fuel. Additional difficulties have been encountered with existing stoves in attempting to provide for complete burning of the gases and volatiles released by combustion of the wood or other fuel. As a result, combustible products, such as creosote, are often deposited on the interior surfaces of the exhaust piping.

It is, therefore, an object of the present invention to provide a space heating stove wherein the operating temperatures within the combustion chamber are maintained above the ignition temperature for the fuel being consumed.

Another object is to provide a space heating stove wherein gases or volatiles released by combustion of the wood or fuel are substantially completely burned before the gases or volatiles are exhausted from the stove. As a result, wood types previously considered unsafe for heating purposes, due to creosote build-up can be used.

A further object of the invention is the provision of a space heating stove wherein heat is efficiently transferred from the stove to room air without decreasing the combustion chamber temperature.

Another object is to provide a space heating stove which requires less combustion air and which, therefore, results in less heat loss through the stove's exhaust.

Yet another object is the provision of such a stove which consumes less fuel for a comparable amount of heat generated.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a space heating stove having a combustion chamber defined by a floor, a pair of opposed end walls projecting upwardly from the floor, and a pair of opposed side walls projecting upwardly from the floor and in cooperation with the end walls to enclose the chamber; the floor, the end walls and the side walls are formed by heat resistant and heat insulating ceramic material or firebrick; means are provided in operative relationship with the floor and the walls for supporting the floor and the walls; each of the end walls defines a first opening therein, and a perforated, heat and oxidation resistant cylindrical member extends through the combustion chamber and is positioned within the openings; a front plate member projects upwardly from the support means and in spaced apart relationship with respect to a rear one of the end walls; a front baffle member is located adjacent to the front end wall between the front end wall and the front plate member and projects beyond an upper edge of the front end wall along that upper edge to a predetermined location above the support means; a rear baffle member is located adjacent to the rear end wall between the rear end wall and the rear plate member and projects beyond an upper edge of the rear end wall along that upper edge to a predetermined location above the support means; first and second plate members are positioned in contacting relationship with the front and rear plate members and with the front and rear baffle members and in spaced apart relationship from the side walls; an exhaust port is attached to the first and second plate members and in fluid communication with the combustion chamber; a shroud is attached to and in spaced apart relationship from the first and second plate members; the front end wall further defines a second opening for enabling loading of fuel into the combustion chamber; the front plate member also defines an additional opening in substantial alignment with the second opening; panel members are provided to connect the second opening and the additional opening whereby a passage is formed for receiving fuel into the combustion chamber; and a door is hinged to the front plate member for closing the second opening and the passage.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
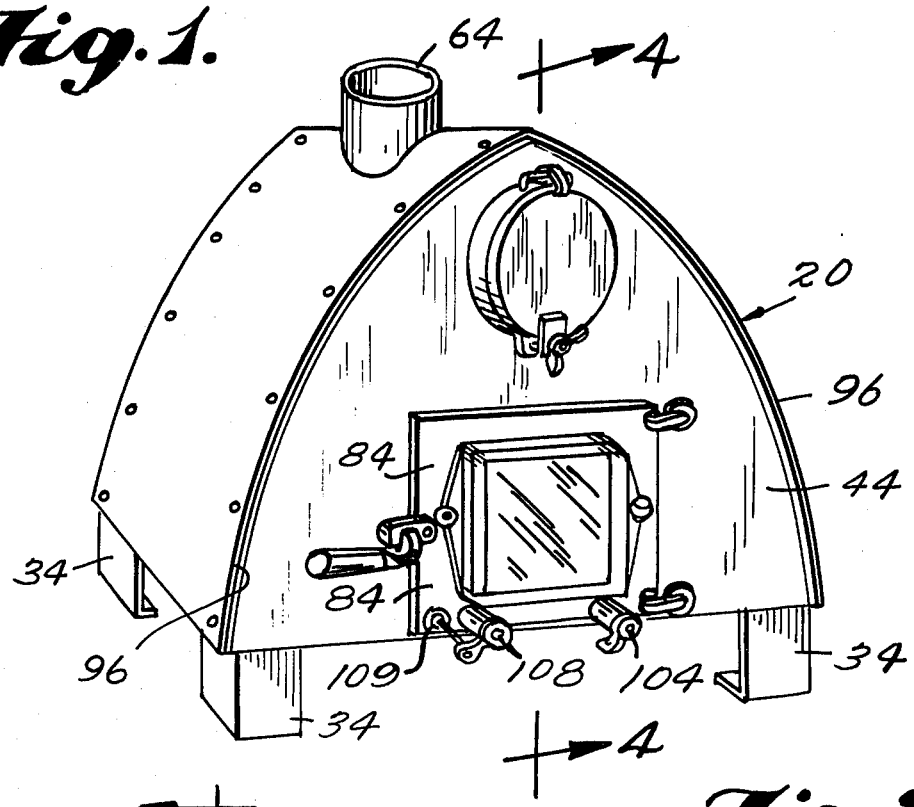
FIG. 1 is a perspective view of the stove.
Figure 2:
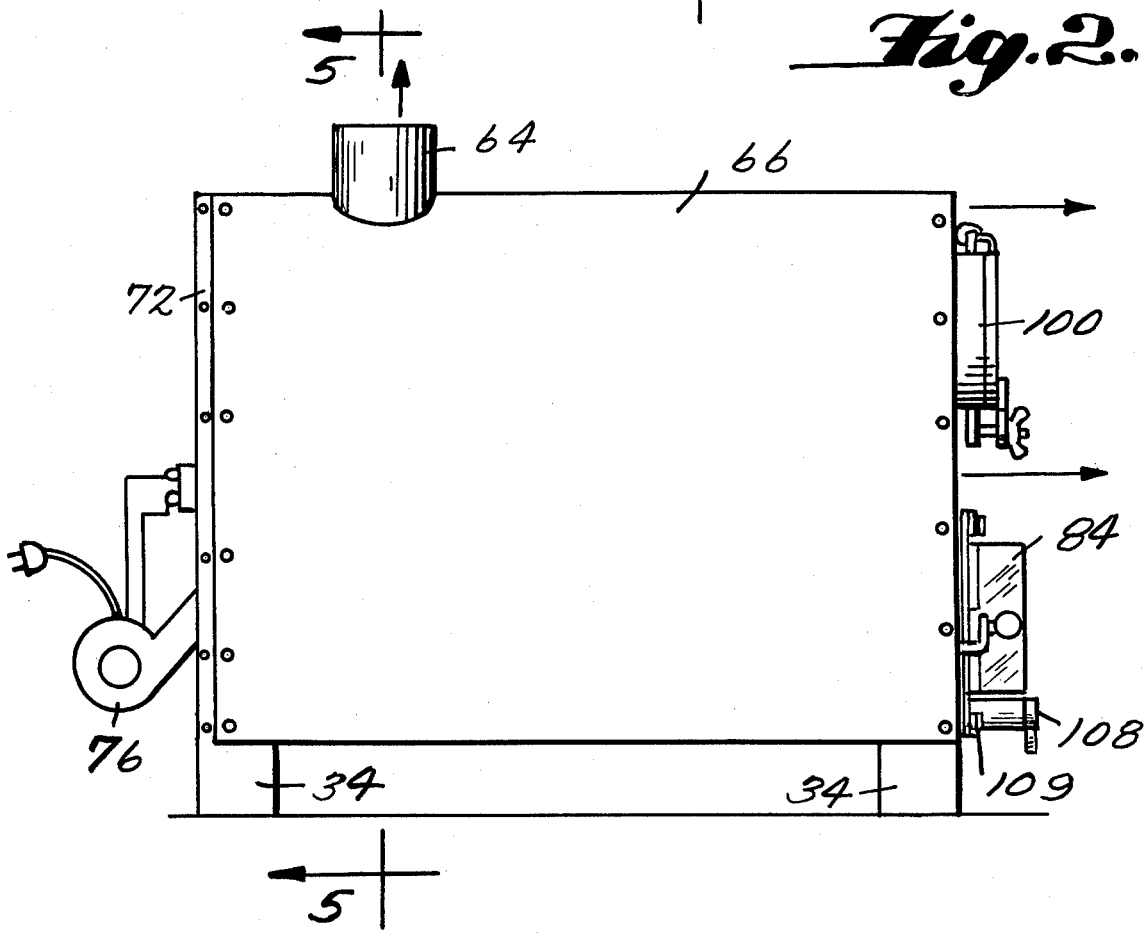
FIG. 2 is a side elevation view of the stove.
Figure 3:
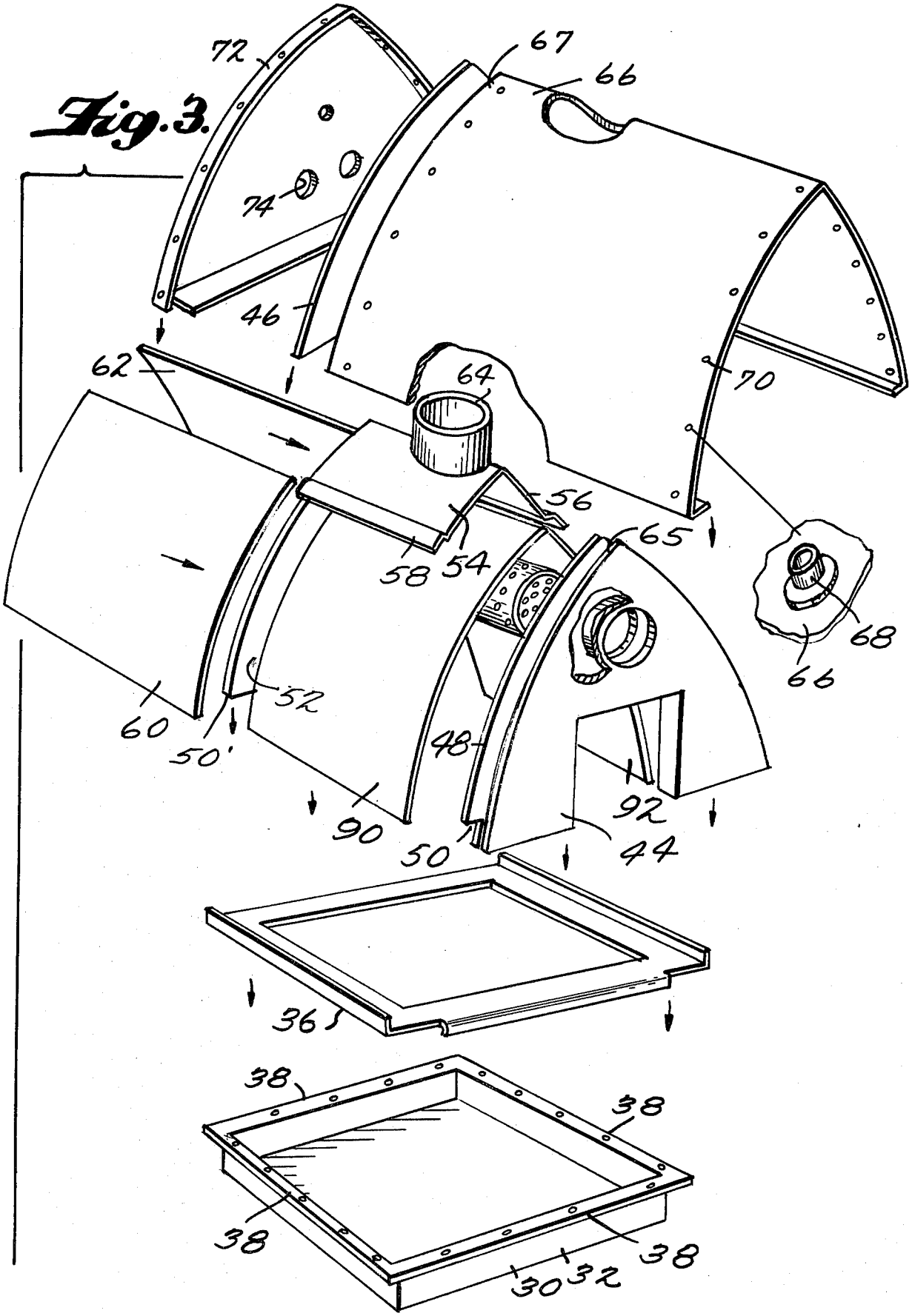
FIG. 3 is an exploded perspective view of the stove but not illustrating the firebrick.
Figure 4:
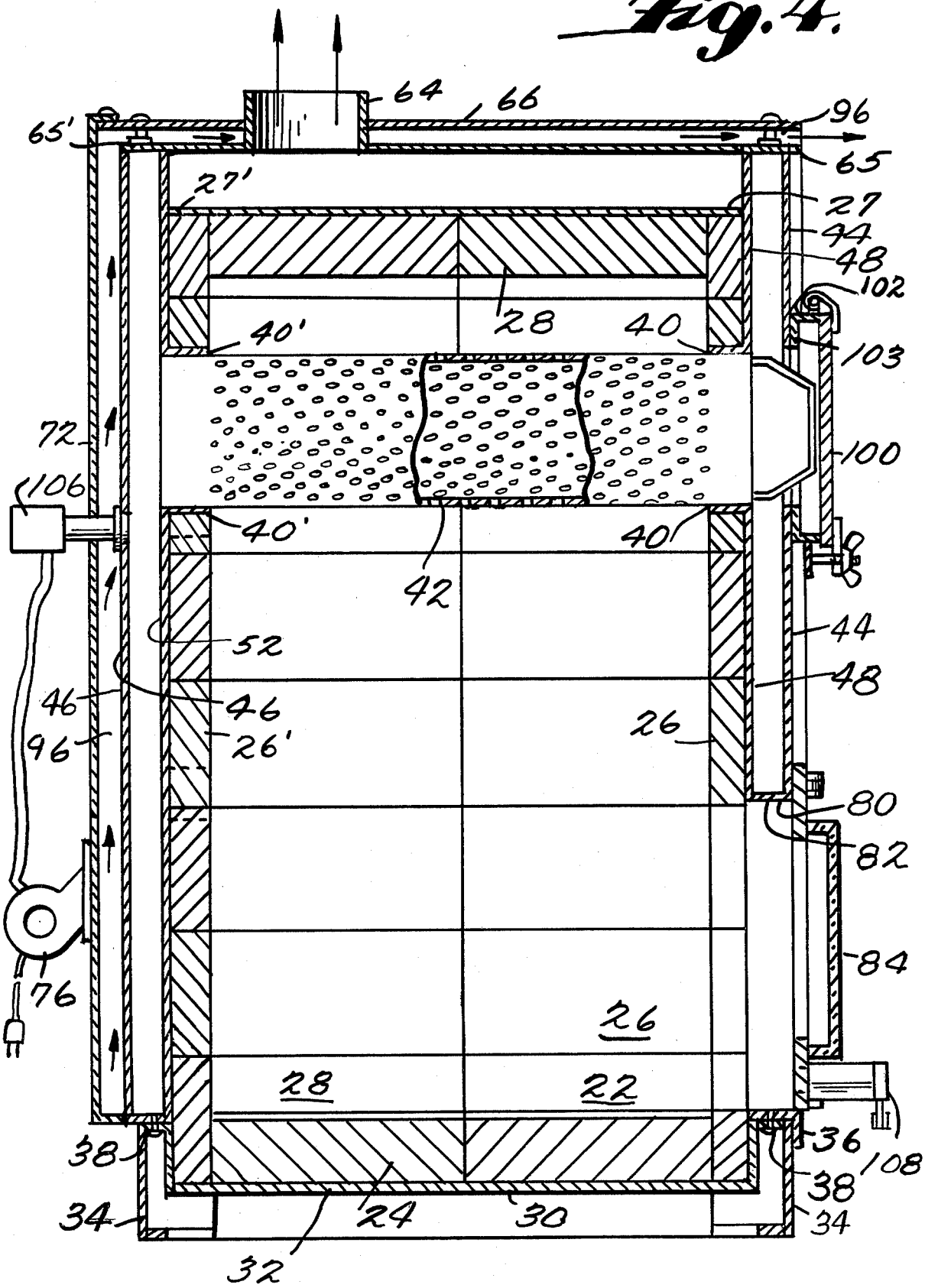
FIG. 4 is a cross sectional view of the stove taken along the centerline.
Figure 5:
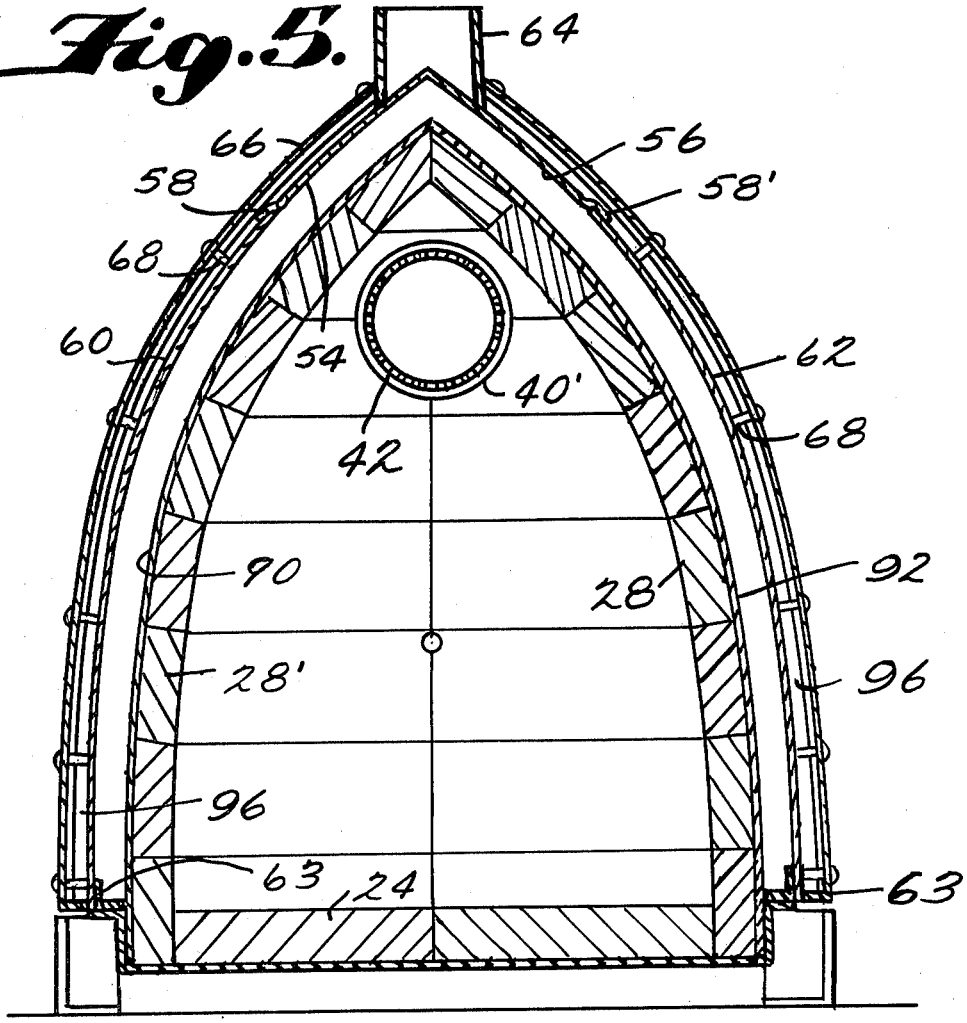
FIG. 5 is a cross sectional view of the stove taken along the line 5—5 in FIG. 2 and looking in the direction of the arrows.

With reference now to the drawings, wherein like reference characters designate like or corresponding parts throughout the several views, there is shown a space heating stove or furnace 20. A combustion chamber 22 is provided, which is defined by a floor 24, a pair of opposed end walls 26, 26' projecting upwardly from the floor and in cooperation with side walls 28, 28' to enclose chamber 22. In accordance with this invention, floor 24, end walls 26, 26' and side walls 28, 28' are formed from heat resistant and heat insulating ceramic material, such as firebrick.

Means 30 are provided for supporting floor 24 and walls 26, 26', 28, 28'. Supporting means 30 include a base pan 32 and a support member 36 positioned on and removably fastened to a flange 38 of the base pan. Feet 34 are connected to support member 36, such as by welds or other conventional means.

Each of end walls 26, 26' defines a first opening 40, 40' therein, and a perforated, heat and oxidation resistant, hollow cylindrical member or combustor 42 extends through combustion chamber 22 and is positioned within openings 40, 40'.

A front plate member 44 is welded to and projects upwardly from support member 36, and plate member 44 is in spaced apart and substantially parallel relationship with respect to front end wall 26. Similarly, a rear plate member 46 is welded to and projects upwardly from support member 36, and rear plate member 46 is in spaced apart and substantially parallel relationship with respect to rear end wall 26'.

A front baffle member 48 is located adjacent to front end wall 26 and between the front end wall and front plate member 44. Baffle member 48 may be welded to support member 36 or baffle member 48 may be attached by other conventional means to front end wall 26. Baffle member 48 projects beyond upper edge 27 of front end wall 26, and the baffle extends along edge 27 to a location 50 above support member 36.

First and second plate members 54, 56 are positioned in contacting relationship with and are welded to front and rear plate members 44, 46. First and second plate members 54, 56 are also positioned in contacting relationship with front and rear baffle members 48, 52. Plate members 54, 56 are also located in spaced apart relationship from side walls 28, 28'. As illustrated in the figures, plate members 54, 56 may cover only a portion of side walls 28, 28'. In the embodiment illustrated, each of plate members 54, 56 is provided with a flange 58, 58', and third and fourth plate members 60, 62, respectively, are fitted beneath flanges 58, 58'. Plate members 60, 62 are also positioned in contacting relationship with baffle members 48, 52 and with plate members 44, 46. Plate members 60, 62 are also attached to support member 36 by means of screws or other fastening means 63.

An alternative embodiment, not illustrated, would provide for each of the plate members 60, 62 to extend continuously from support member 36 upwardly to the top or apex 65, 65' of front and rear plate members 44, 46.

An exhaust port 64 is welded or otherwise attached to plate members 54, 56, and the interior of exhaust port 64 is located in fluid communication with combustion chamber 22.

Plate members 54, 56, 60, and 62 are provided with mounting and spacer elements (e.g. threaded weld-nuts) 68, and a shroud 66 defining a plurality of holes 70 is positioned over plates 54, 56, 60, 62 and in spaced apart relationship therefrom. Holes 70 are aligned with elements 68, and nuts or other conventional fastening elements are attached to elements 68 for the purpose of holding shroud 66 in fixed position. A rear shroud member 72 is attached to shroud 66 by means of screws or other fasteners 67 and in spaced apart relationship from rear plate member 46. Rear shroud member 72 defines at least one opening 74 for permitting a fan 76 to be connected in fluid communication with the space formed between shroud member 72 and rear plate member 46. Fan 76 is also in fluid communication with the space formed between shroud 66 and plate members 54, 56, 60 and 62.

Front end wall 26 further defines a second opening 78 for enabling loading of wood or other fuel into combustion chamber 22. Front plate member 44 also defines an additional opening 80 in substantial alignment with opening 78, and panel member 82 are connected between openings 70 and 80 to form a passage for receiving fuel into the combustion chamber.

A door 84 is hinged to front plate member 44 and is movable about its hinges for opening and closing the passage formed between openings 78, 80.

Front plate member 44, front baffle member 48, plate members 54, 56, 60, 62, panel members 82 and support member 36 form a first space 86 in fluid communication with front end wall opening 40 and with combustion chamber 22 for receiving combustion gases from the combustion chamber through opening 40 and for directing the gases downwardly toward front corners of support member 36.

Similarly, rear plate member 46, rear baffle member 52, plate members 54, 56, 60, 62, and support member 36 form a second space 88 in fluid communication with rear end wall opening 40' and with combustion chamber 22 for receiving combustion gases from the combustion chamber through opening 40' and for directing the gases downwardly toward rear corners of support member 36.

In accordance with a preferred embodiment of the invention, fifth and sixth curved plate members 90, 92 may be positioned over and immediately adjacent to side walls 28, 28', and the curved plate members are attached to front and rear baffle members 48, 52 by welding or other conventional means.

Curved plate members 90, 92, or in their absence the exterior surfaces of side walls 28, 28', front and rear baffle members 48, 52, support member 36, and plate members 54, 56, 60, 62 define a third space 94 in fluid communication with first and second spaces 86, 88 and with exhaust port 64 for directing combustion gases and volatiles from spaces 86, 88 to exhaust port 64.

Fan or blower 76 is provided in fluid communication with ambient air and with a fourth space 96 between plate members 54, 56, 60, 62 and shroud members 66, 72 for forcing ambient air into, through and out of space 96 and over plate members 54, 56, 60, 62 whereby the ambient air is heated by contact with plate members 54, 56, 60, 62.

Front plate member 44 further defines opening 98 in substantial alignment with opening 40 and of a diameter greater than the diameter of cylindrical member 42. A cover 100 is removably attached to front plate member 44 by means of ring member 102, and cover 100 is normally positioned to cover opening 98. Ring member 102 is attached to front plate member 44 by means of screws or other fastening member 103.

The floor and walls of combustion chamber 22 are made from a heat resistant and heat insulating ceramic material, such as firebrick, which is resistant to high temperatures and which is highly heat insulating. Because the combustion chamber is enclosed by firebrick, the operating temperature within the combustion chamber can be maintained as high as 1500° Farenheit. This temperature is sufficiently above the ignition temperature for the wood or other fuel being consumed.

Cylindrical member or combustor 42 is preferably made from heat and oxidation resistant steel. The combustor is in the shape of a hollow cylinder with many small holes located completely around the circumference of the cylinder and through which all products of combustion must pass. The diameter, length, hole size and hole spacing of the combustor will depend upon the type of fuel being consumed, the quantity of fuel to be consumed, and the rate of heat output desired. The stove model constructed used a combustor twenty inches long, five and one half inches in diameter, one thirty-second inch thick and with one sixteenth inch diameter holes spaced one quarter inch apart.

In operation of the stove, combustion gases and other volatiles will be partially burned within the combustion chamber because of the high sustained temperatures maintained therein. The high sustained temperatures within combustion chamber 22 are achieved because of the insulating properties of the firebrick substantially completely enclosing the combustion chamber. Combustor 42, positioned within combustion chamber 22, is also heated to these very high temperatures. All gaseous combustion products must pass through combustor 42 before they exit the combustion chamber. As a result, a large proportion of the unburned combustion gases are burned as they pass through and come into contact with the heated combustor.

Figure 6:
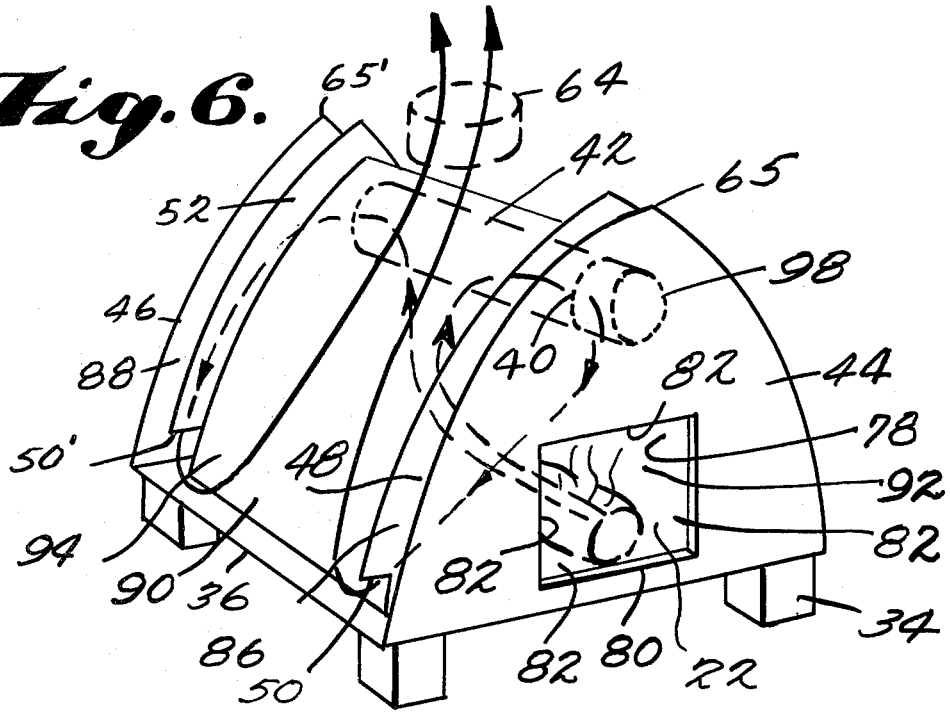
FIG. 6 is a fragmentary perspective view of the stove with flow lines illustrating the path followed by the combustion products.

As shown in FIG. 6, heated gases and combustion products from combustion chamber 22 pass into the interior of combustor 42 through the holes in the wall of the combustor. The heated gases then divide and exit the combustor through openings 40, 40' in end walls 26, 26'. The gases then pass downwardly within spaces 86, 88 toward the front and rear corners of support member 36. The heated gases then combine as they enter space 94, and the gases pass upwardly through space 94 and into exhaust port 64. Plates 54, 56 60, 62 are heated as the gases pass through space 94.

Blower 76 takes ambient air and forces it through space 96 where the air is heated by contact with heated plates 46, 54, 56, 60, 62. The heated air then exits from space 96 at the front of the stove where it joins the surrounding ambient air.

Thermostat 106 is connected in electrical circuit with fan 76 to control operation of the fan. The thermostat detects the temperature of rear plate member 46, which temperature is related to the exhaust gas temperature after leaving cylindrical member or combustor 42. Thermostat 106 is set to activate blower 76 when plate member 46, as well as plate members 60, 62, are hot enough to heat air passing over the plates to a sufficient temperature. Thermostat 106 is also set to turn off blower 76 when plate member 46 drops to a predetermined temperature. This avoids circulating air into the room which has not been heated to the desired degree. For example, thermostat 106 may be set to activate fan 76 when the temperature of plate member 46 reaches 140° F. and to turn off the fan when the temperature of plate member 46 drops to 120° F. Of course, any desired temperature range may be used.

Door 84 is preferably provided with heat resistant glass to permit viewing of the combustion chamber. Damper drafts 104, 108 located in the door control the amount of air permitted into the combustion chamber and so control the rate of combustion of the fuel. Draft 104 is a manually controlled draft. Draft 108 is controlled by its own bimetallic element 109 which senses the temperature of door 84, which in turn is relative to the temperature within chamber 22.

The function of combustor 42 is important to the successful operation of the stove. Because of the high sustained temperatures maintained within the combustion chamber, the combustor is maintained at substantially these same high temperatures. Thus, unburned combustion gases, which are not burned by contact with the flames within the combustion chamber, are burned as they contact and pass through the combustor. As a result, a very large percentage of the combustible gases and volatiles are burned prior to being exhausted from the stove through exhaust port 64. Creosote and carbon deposits within the stove and within exhaust port 64 are significantly reduced. More heat is also generated within the combustion chamber because of the more complete combustion therein of the combustible gases. The quantity of fuel required to achieve comparable heating with known stoves is also significantly reduced. Greater choices of fuel are available since wood types previously considered unsafe for heating purposes, due to creosote build-up, now are practical.

This invention provides for a highly efficient space heating stove wherein the fuel is burned at extremely high temperatures and wherein a large portion of the combustion products are burned before being exhausted from the stove. The efficiency achieved results in greater heating capacity with the use of less fuel, and the efficiency of combustion significantly reduces the build-up of creosote and carbon within the stove and within the exhaust port. The efficiency of combustion achieved by the stove also reduces the amount of combustion air required to sustain the most efficient burning of the fuel. As a result, less heat is lost through the exhaust and less infiltration heat loss to the surrounding area results.

The invention in its broader aspects is not limited to the specific details shown and described, and departures may be made from such details without departing from the principles of the invention and without sacrificing its chief advantages.

What is claimed is:

1. A space heating stove, comprising:

a combustion chamber defined by a floor, a pair of opposed end walls projecting upwardly from said floor, and a pair of opposed side walls projecting upwardly from said floor and in cooperation with said end walls to enclose said chamber;

said floor, said end walls and said side walls formed by heat resistant and heat insulating ceramic material;

means in operative relationship with said floor and said walls for supporting said floor and said walls;

each of said end walls defining a first opening therein, and a perforated, heat and oxidation resistant, cylindrical member extending through said combustion chamber and positioned within said openings;

a front plate member projecting upwardly from said support means and in spaced apart relationship with respect to a front one of said end walls;

a rear plate member projecting upwardly from said support means and in spaced apart relationship with respect to a rear one of said end walls;

a front baffle member located adjacent to said front end wall between said front end wall and said front plate member and projecting beyond an upper edge of said front end wall along said upper edge to a predetermined location above said support means;

a rear baffle member located adjacent to said rear end wall between said rear end wall and said rear plate member and projecting beyond an upper edge of said rear end wall along said upper edge to a predetermined location above said support means;

first and second plate members positioned in contacting relationship with said front and rear plate members and with said front and rear baffle members and in spaced apart relationship from said side walls;

an exhaust port attached to said first and second plate members and in fluid communication with said combustion chamber;

a shroud attached to and in spaced apart relationship from said first, second and rear plate members;

said front end wall further defining a second opening for enabling loading of fuel into said combustion chamber, wherein said front plate member also defines an additional opening in substantial alignment with said second opening, and further including panel members connecting said second opening and said additional opening to form a passage for receiving fuel into said combustion chamber; and a door hinged to said front plate member for closing said second opening and said passage.

2. A stove as in claim 1 wherein said front plate member, said front baffle member, said first and second plate members, said panel members and said support means form a first space in fluid communication with said front end wall opening and with said combustion chamber for receiving combustion gases from said chamber through said opening and for directing said gases downwardly toward front corners of said support means.

3. A stove as in claim 2 wherein said rear plate member, said rear baffle member, said first and second plate members and said support means form a second space in fluid communication with said rear end wall opening and with said combustion chamber for receiving combustion gases from said chamber through said rear end wall opening and for directing said gases downwardly toward rear corners of said support means.

4. A stove as in claim 3 wherein said first and second plate members each define a flange, and further including third and fourth plate members respectively positioned between said flanges of said first and second plate members and said front and rear plate members and wherein said third and fourth plate members extend in contacting relationship along upper edges of said front and rear plate members and along upper edges of said front and rear baffle members and wherein said third and fourth plate members are attached to said supporting member.

5. A stove as in claim 4 further including fifth and sixth curved plate members positioned over and immediately adjacent to said side walls and attached to said front and rear baffle members.

6. A stove as in claim 5 wherein said curved plate members, said front and rear baffle members, said support means, and said first, second, fifth and sixth plate members define a third space in fluid communication with said first and second spaces and with said exhaust port for directing combustion gases from saidfirst and second spaces to said exhaust port.

7. A stove as in claim 6 further including a blower in fluid communication with ambient air and with a fourth space between said first and second plate members and said shroud for forcing ambient air into, through and out of said fourth space and over said first, second, third and fourth plate members, whereby said ambient air is heated by contact with said first, second, third and fourth plate members.

8. A stove as in claim 7 further including a thermostat positioned to sense the temperature of said rear plate member, said thermostat in operative relationship with said blower for controlling operation of said blower.

9. A stove as in claim 8 wherein said front plate member defines an opening in substantial alignment with said first opening in said front wall and of a diameter greater than the diameter of said cylindrical member, and a removable cover normally positioned on said front plate member to cover said opening in said front plate member.

10. A stove as in claim 9 wherein said door includes a draft control to regulate the amount of ambient air drawn into said combustion chamber during combustion of the fuel.

11. A stove as in claim 10 further including a bi-metallic element positioned to sense the temperature of said door, and a dampered opening in said door, said damper in operative relationship with said bi-metallic element for automatically controlling the amount of ambient air drawn into said combustion chamber during combustion of the fuel as determined by the temperature of said door and within said combustion chamber.

12. A stove as in claim 11 wherein said cylindrical member is made of steel.

* * * * *